United States Patent [19]

Sakamoto

[11] Patent Number: 4,694,716

[45] Date of Patent: Sep. 22, 1987

[54] MACHINE FOR CUTTING SOLID BODIES

[75] Inventor: Tsutomu Sakamoto, Hirakata, Japan

[73] Assignee: Kansai Environmental Development Co., Ltd., Japan

[21] Appl. No.: 834,537

[22] Filed: Feb. 28, 1986

[51] Int. Cl.[4] ..... B26D 1/09

[52] U.S. Cl. ..... 83/112; 83/160; 83/459; 83/561; 83/620; 83/639; 83/923; 83/925 R; 83/DIG. 1

[58] Field of Search ..... 83/160, 133, 143, 111, 83/112, 267, 459, 272–275, 556, 561, 562, 620, 621, 639, 925 R, 923, DIG. 1; 157/13

[56] References Cited

U.S. PATENT DOCUMENTS

| | | | |
|---|---|---|---|
| 2,926,712 | 3/1960 | Lindauer, Jr. | 83/561 |
| 2,952,372 | 9/1960 | Foss | 83/620 |
| 3,839,935 | 10/1974 | Daniels | 83/160 |
| 3,911,772 | 10/1975 | Kisielewski | 83/925 R |
| 3,922,942 | 12/1975 | Fawcett et al. | 83/620 |
| 4,338,840 | 7/1982 | Farrell, Sr. et al. | 83/622 |
| 4,355,556 | 10/1982 | Ulsky | 83/54 |

*Primary Examiner*—E. R. Kazenske
*Assistant Examiner*—Hien H. Phan
*Attorney, Agent, or Firm*—Barnes, Kisselle, Raisch, Choate, Whittemore & Hulbert

[57] ABSTRACT

A cutting machine for solid bodies such as rubber tires according to the invention comprises a blade base 14 moved vertically by pressing cylinders 1. Downwardly directed cutting blades 18 are mounted on the underside of the blade base 14. These blades 18 can retractably project through slits 15*a* formed in a presser plate 15 positioned below the blade base 18. Rubber tires $T_1$ placed on a receiver 27 are cut by the blades 18 with the presser plate 15 compressively retaining the tires $T_1$. The resultant cut pieces are discharged by horizontally moving an accommodating box 22 through discharge cylinders 23. The receiver 27 is slightly rotated after a predetermined number of cutting operations.

5 Claims, 7 Drawing Figures

MACHINE FOR CUTTING SOLID BODIES

FIELD OF THE INVENTION

The invention relates to a machine for cutting solid bodies, more particularly, to a cutting machine for cutting solid bodies to facilitate transportation of used rubber tires.

BACKGROUND OF THE INVENTION

With the recent increase of automobiles, there has been a drastic increase in the number of used tires. Because the tires are heavy and bulky in their original form, it is troublesome and costly to handle them and to transport them to proper dumping areas. Further, due to their high elasticity the tires are reluctantly subject to treatment by conventional shearing or cutting machines. Thus, only a small portion of the spent tires has been effectively utilized as material for regenerated rubber or as an alternative fuel source, whereas the majority has been illegally discarded unprocessed in various places to invite an industrial waste pollution.

SUMMARY OF THE INVENTION

It is therefore an object of the invention to provide a cutting machine capable of easily and reliably cutting solid bodies such as used tires.

To fulfill this object, the present invention provides a cutting machine which comprises: at least one pressing cylinder means having a vertically movable piston rod; a blade base fixed to the lower end of said piston rod; a plurality of downwardly directed cutting blades mounted on the underside of said blade base; a presser plate disposed below said blade base and having a corresponding number of slits through which said blades are allowed to freely pass; a receiver arranged below said presser plate for placing thereon a solid body or bodies to be cut; rotary drive means for causing said receiver to slightly rotate after a predetermined number of cutting operations; and discharge means for horizontally moving cut solids.

According to the construction described above, when the blade base moves downward to conduct cutting of the solid body by the blades, the presser plate pressingly holding the body prevents the body or the cut pieces thereof from sliding laterally or scattering even if the body is highly elastic. Further, the slight rotation of the receiver by the rotary drive means after a predetermined number of cutting operations eliminates the likelihood that the blades concentratively damage the specific portions of the receiver, consequently prolonging the service life of the receiver.

Various features and advantages of the invention will become apparent from the following description of a preferred embodiment given with reference to the accompanying drawings.

DETAILED DESCRIPTION

Figure 1:
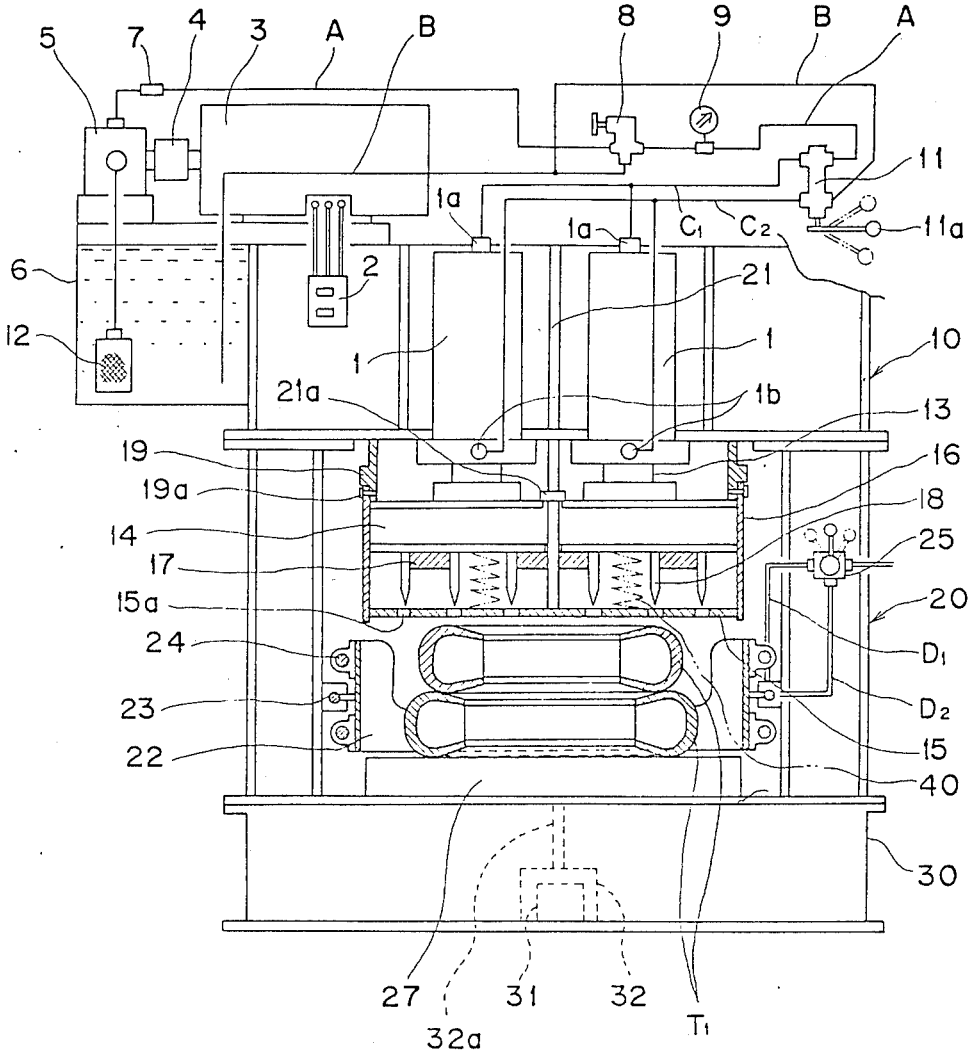
FIG. 1 is a front elevation partly in section of a cutting machine embodying the inevtnion.

Referring to FIG. 1, the cutting machine according to the present invention principally comprises an upper structure 10, a middle structure 20, and a lower structure 30. The upper structure 10 is provided with a pluarlity (four in the illustrated example) of double acting cylinders 1 which are connected to a changeover valve 11 through control lines $C_1$, $C_2$ communicating with control holes 1*a*, 1*b*. The valve 11 operable by a control level 11*a* is connected to a feed line A and return line B both communicating a tank 6. A working fluid sucked up from the tank 6 by the pump 5 through a filter 12 flows under pressure through the feed line A. The feed line A is provided with a check valve 7, a pressure regulating valve 8 (relief value), and a pressure gauge 9. The relief valve 8 is also connected with the return line B to allow the working fluid in the feed line A to return to the tank 6 through the return line B when the fluid pressure within the feed line A exceeds a predetermined value. The pump 5 is actuated by a motor 3 through a coupling 4, the motor 3 being controlled by a switch 2.

Figure 3:
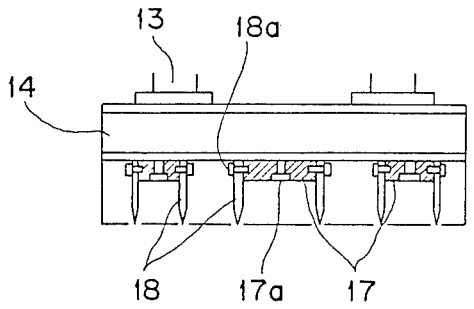
FIG. 3 is a front elevation showing the blade base of the cutting machine with cutting blades mounted thereon.
Figure 4:
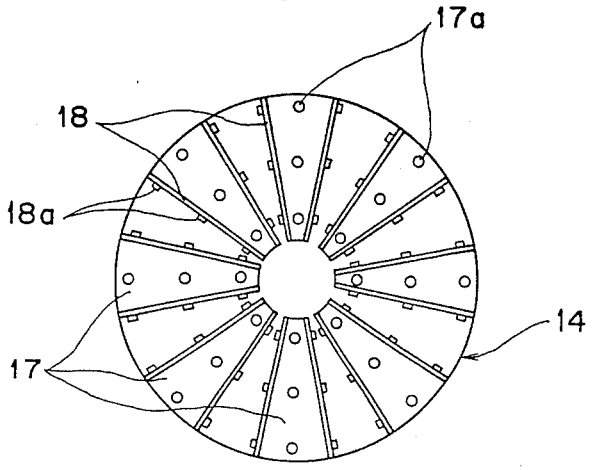
FIG. 4 is a bottom plan view of the blade base.

A circular blade base 14 is fixed to the lower ends of the cylinder piston rods 13. As best shown in FIGS. 3 and 4, a plurality (eight in the illustrated embodiment) of equiangularly spaced sectorial mounting blocks 17 are fixed to the underside of the blade base 14 by bolts 17*a*. Downwardly directed cutting blades 18 are fixed to both side edges of each mounting block 17 by bolts 18*a*.

Figure 5:
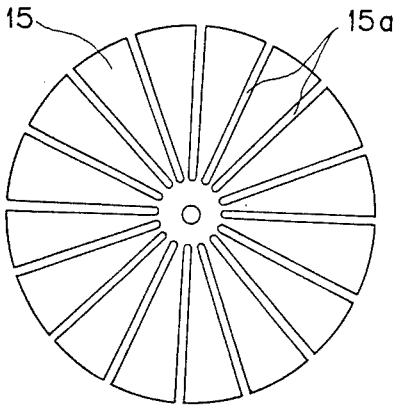
FIG. 5 is a plan view showing the presser plate of the cutting machine.

Arranged below the blade base 14 is a presser plate 15 equal in diameter to the base. As shown in FIG. 5, the presser plate 15 is provided with radially extending slits 15*a* for allowing the free passage therethrough of the cutting blades 18. A sliding rod 21, which extends vertically through the center of the blade base 14, is fixed at the lower end thereof to the center of the presser plate 15 and provided at an intermediate portion thereof with a flange 21*a* engageable with the upper face of the blade base 14. It should be understood that the parts represented by reference numeral 40 will be described later in connection with a modification and should be thus regarded as non-existent in this example.

The blade base 14 and the presser plate 15 are slidably guided in a vertically extending cylindrical guide 16. The lower end of a cylindrical stopper 19 fits into the upper end of the cylindrical guide 16 and is fixed thereto by bolts 19*a*. The lower end of the cylindrical stopper 19 is engageable with the upper face of the blade base 14, whereas the upper end of the stopper 19 is adapted to abut against the lower face of the upper structure 10.

Figure 6:
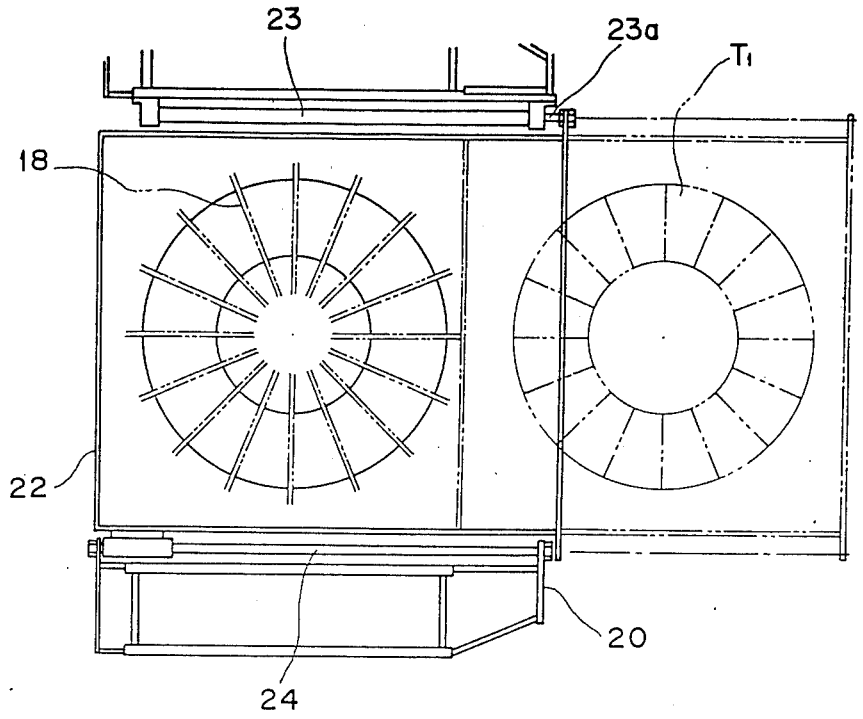
FIG. 6 is a plan view showing the discharge means of the cutting machine.
Figure 7:
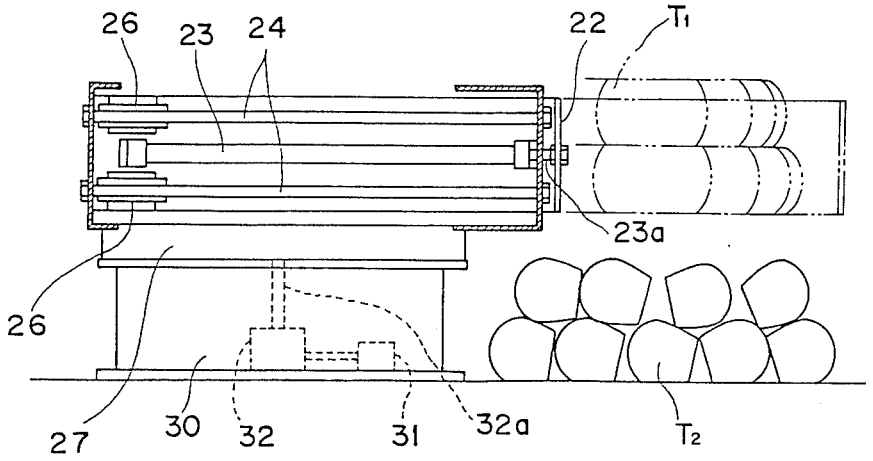
FIG. 7 is a side view of the discharge means.

As shown in FIGS. 1, 6, and 7, the cutting machine is further provided with an accommodating member 22 below the blade base 14, presser plate 15, and cylindrical guide 16 raised to their respective upper limit positions shown in FIG. 1. The accommodation member 22 according to the illustrated example is in the form of a rectangular box open at the top and the bottom. On both sides of the accommodation box 22 there are arranged a pair of discharge cylinders 23 fixed to the middle structure 20. The discharge cylinders 23 have piston rods 23*a* fixed to the accommodation box 22. A pair of guide rods 24, which extend parallel to each discharge cylinder 23 respectively thereabove and therebelow, are fixed to the middle structure 20. The accommodation box 22 is slidably guided by the rods 24 through bosses 26. The discharge cylinders 23 are connected to a changeover valve 25 through control lines $D_1$, $D_2$ as shown in FIG. 1. The piston rods 23*a* of the cylinders 23 are reciprocated by operating the changeover valve 25.

As shown in FIGS. 1 and 7, immediately below the accommodation box 22 is provided a receiver 27 for placing thereon rubber tires $T_1$. The receiver 27 is coupled to the output shaft 32*a* of a speed reduction device 32 disposed inside the lower structure 30, and the device 32 is in turn connected to a motor 31.

The cutting machine of the above arrangement operates in the following manner.

First, as shown in FIG. 1, with the blade base 14 raised to its upper limit position the tires $T_1$ are brought into the accommodating box 22 by an unillustrated feed device and placed on the receiver 27 one above the other. At this time, since the cylindrical stopper 19 and the flange 21*a* of the slider rod 21 engage the upper face of the blade base 14, the cylindrical guide 16 and the presser plate 15 are also held in their upper limit positions. Subsequently, with the control lever 11*a* of the changeover valve 11 kept in its neutral positon, the switch 2 is turned on to actuate the pump 5 and to thereby cause the working fluid in the tank 6 to flow into the feed line A through the filter 12. However, since the neutrally held changeover valve 11 is closed to both control lines $C_1$, $C_2$, the pressure in the feed line A develops enough to return the fluid to the tank 6 through the relief valve 8 and the return line B.

Figure 2:
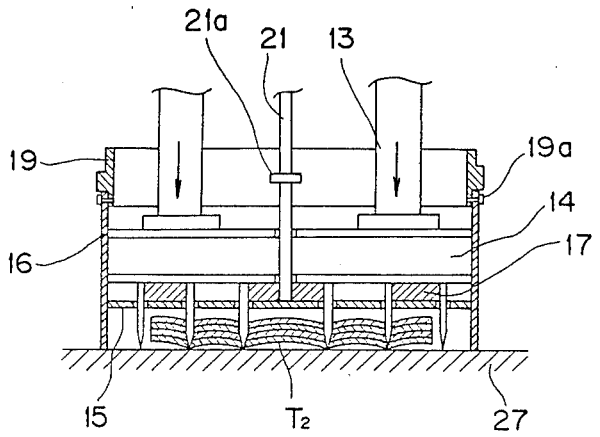
FIG. 2 is a fragmentary sectional view showing the principal portion of the same machine in a cutting state.

For initiating a cutting operation, the control lever 11*a* is shifted to a first operating position in which the feed and return lines A, B are connected respectively to the control lines $C_1$, $C_2$. Consequently, the piston rods 13 of the double acting cylinders 1 start moving downward to lower the blade base 14. In the initial stage of the downward movement of the blade base 14, the presser plate 15 and the cylindrical guide 16 are gravitationally moved downward together with the base 14. Upon further downward movement of the base 14, the presser plate 15 comes into abutment with the upper rubber tire $T_1$ and is thereby hindered from its further downward movement, while the base 14 and the guide 16 continue their downward movement. As a result, the cutting blades 18 project downwardly through the slits 15*a* of the presser plate 15 to start cutting the tires $T_1$, and the cylindrical guide 16 starts forming an enclosure around the Tire $T_1$. The tires $T_1$ are elastically compressed during the initial stage of cutting by the blades 18, so that the presser plate 15 gravitationally moves downward at a lower speed than the base 14. As the cutting by the blades 18 progresses, the mounting blocks 17 come into pressing contact with the presser plate 15 and cause the plate 15 to prevent the tires $T_1$ or their cut pieces from sliding laterally or scattering away. On the other hand, even if the lateral sliding or scattering of the tires $T_1$ or the cut pieces should occur, such phenomena are limited within the enclosure provided by the cylindrical guide 16 downwardly moving to and held in its lower limit position, whereby the cutting operation can be reliably conducted. FIG. 2 shows the cutting machine at the final stage of the cutting process. At this time, hundreds of tons of pressure is applied to the blade base 14.

Upon shifting the control lever 11*a* of the changeover valve 11 to a second operating position in which the feed and return lines A, B are connected respectively to the control lines $C_2$, $C_1$, the piston rods 13 of the cylinders 1 start rising to lift the blade base 14. However, since the cylindrical stopper 19 is still not in engagement with the base 14, the cylindrical guide 16 does not rise immediately, which results in that the enclosure formed by the guide 16 remains for the time being. Further, the elastic expansion of the cut pieces $T_2$ is allowed only by the gradually rising presser plate 15 in contact with the pieces $T_2$. Accordingly, the cutting machine can return to its original state shown in FIG. 1 while preventing the pieces $T_2$ from scattering away during the upward movement of the blade base 14.

To start a discharging operation, the changeover valve 25 (FIG. 1) is operated to stretch out the piston rods 23*a* of the discharge cylinders 23. As a result, the accommodation box 22 is brought to a discharge position represented by phantom lines in FIGS. 6 and 7, causing the cut fragments $T_2$ to fall through the open bottom of the accommodation box 22. Subsequently, the piston rods 23*a* of the discharge cylinders 23 are withdrawn to return the accommodation box 22 to its original position.

A cycle of cutting and discharging is thus completed. As a result of repeated cycles of cutting and discharging, cut marks are formed on the receiver 27 by the blades 18. Such cut marks can adversely affect the service life of the receiver 27 if the number of the cutting-discharging cycles increase. According to the present invention which has eliminated this problem, the motor 31 is actuated to rotate the receiver 27 through a small angle (e.g. 2–10 degrees) by way of the reduction device 32.

Optionally, coil springs 40 may be disposed between the blade base 14 and the presser plate 15 as shown by phantom lines in FIG. 1. In this case, the coil springs 40 not only permit the presser plate 15 to compressively retain the rubber tires $T_1$, more effectively but also help to forcibly remove the cut fragments $T_2$ held interposed between the blades 18 during the upward movement of the base 14.

Although the tires $T_1$ are arranged one above the other according to the illustrated embodiment. a single tire may also be cut by the present machine. Further, the rubber tires $T_1$ may be replaced by any other solid bodies of rubber, metal, stone and the like.

What is claimed is:

1. A machine for cutting solid bodies comprising: at least one pressing cylinder means having a vertically movable piston rod; a blade base fixed to the lower end of said piston rod; said blade base having an underside on which a plurality of downwardly directed cutting blades are mounted; a presser plate disposed below said blade base and having a corresponding number of slits through which said blades are allowed to retractably project downward; said presser plate having a center to which a vertical sliding rod is fixed at the lower end thereof; said blade base having a center through which said sliding rod slidably extends; said sliding rod being provided at an intermediate portion thereof with a flange; said blade base having an upper face engagable with said flange and capable of lifting said presser plate; a receiver arranged below said presser plate for placing thereon a solid body or bodies to be cut; rotary drive means for rotating said receiver a predetermined small angle after a predetermined number of cutting operations; and discharge means for horizontally moving cut solids.

2. A cutting machine as defined in claim 1 further comprising a vertically extending cylindrical guide downwardly movable by gravity and slidably guiding said blade base and said presser plate, said cylindrical guide having an upper end to which a cylindrical stopper is fixed, said cylindrical stopper being engageable with said upper face of said blade base.

3. A cutting machine as defined in claim 1 wherein springs are disposed between said blade base and said presser plate to urge said presser plate downwardly.

4. A machine for cutting solid bodies comprising: at least one pressing cylinder means having a vertically movable piston rod; a blade base fixed to the lower end of said piston rod; said blade base having an underside on which a plurality of downwardly directed cutting blades are mounted; a presser plate disposed below said blade base and having a corresponding number of slits through which said blades are allowed to retractably project downward; a receiver arranged below said presser plate for placing thereon a solid body or bodies to be cut; rotary drive means for rotating said receiver a predetermined small angle after a predetermined number of cutting operations; and discharge means for horizontally moving cut solids, said discharge means comprising a rectangualr accommodation box open at the top and bottom thereof, discharge cylinders arranged on one of the two pairs of opposite sides of said accommodation box and each having a piston rod fixed to said box, and guide rods arranged in parallel relation with said discharge cylinders and guiding said accommodation box through bosses fixed to said box.

5. A cutting machine as defined in claim 4 wherein springs are disposed between said blade base and said presser plate to urge said presser plate downwardly.

* * * * *